US010041484B2

(12) United States Patent
Steffen et al.

(10) Patent No.: US 10,041,484 B2
(45) Date of Patent: Aug. 7, 2018

(54) PUMP HAVING INLET RESERVOIR WITH VAPOR-LAYER STANDPIPE

(71) Applicant: Caterpillar Inc., Peoria, IL (US)

(72) Inventors: Joshua W. Steffen, El Paso, IL (US); Sunil J. Bean, Peoria, IL (US); Adrienne M. Brasche, Peoria, IL (US); Cory A. Brown, Peoria, IL (US); Sana Mahmood, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 677 days.

(21) Appl. No.: 14/610,669

(22) Filed: Jan. 30, 2015

(65) Prior Publication Data

US 2016/0222951 A1 Aug. 4, 2016

(51) Int. Cl.

| | |
|---|---|
| ***F04B 23/02*** | (2006.01) |
| ***F04B 15/08*** | (2006.01) |
| *F04B 37/08* | (2006.01) |
| *F04B 53/16* | (2006.01) |
| *F04B 53/14* | (2006.01) |

(52) U.S. Cl.

CPC ..... *F04B 23/02* (2013.01); *F04B 23/023* (2013.01); *F04B 15/08* (2013.01); *F04B 37/08* (2013.01); *F04B 53/14* (2013.01); *F04B 53/16* (2013.01)

(58) Field of Classification Search

CPC .. F04B 15/08; F04B 23/023; F04B 2015/081; F04B 53/00; F04B 53/14; F04B 53/16; F04B 37/08; F04B 15/06; F04B 23/02; F04B 23/021

See application file for complete search history.

(56) References Cited

U.S. PATENT DOCUMENTS

| | | | | |
|---|---|---|---|---|
| 2,837,898 | A * | 6/1958 | Ahlstrand | F04B 11/0083 417/549 |
| 3,136,136 | A | 6/1964 | Gottzmann | |
| 3,212,280 | A * | 10/1965 | Thomas | F04B 7/0073 417/520 |
| 4,239,463 | A | 12/1980 | Yaindl | |
| 4,376,377 | A | 3/1983 | Duron et al. | |

(Continued)

FOREIGN PATENT DOCUMENTS

| | | |
|---|---|---|
| CA | 2 546 315 A1 | 11/2006 |
| CN | 101403381 A | 4/2009 |

(Continued)

OTHER PUBLICATIONS

U.S. Appl. No. 14/597,019, titled "Bearing Arrangement for Cryogenic Pump," filed Jan. 14, 2015, 21 pages.

*Primary Examiner* — Nathan Zollinger

(74) *Attorney, Agent, or Firm* — Finnegan, Henderson, Farabow, Garrett & Dunner, LLP

(57) ABSTRACT

A pump is disclosed having a manifold with an inlet, a pressure outlet, and a return outlet. The pump may also have a jacket connected to an end of the manifold to create an enclosure that is in fluid communication with the inlet of the manifold, and at least one pumping mechanism extending from the manifold into the jacket. The at least one pumping mechanism may have an inlet open to the enclosure and an outlet in communication with the pressure outlet of the manifold. The pump may further have a standpipe extending from the manifold into the enclosure. The standpipe may be in communication with the return outlet of the manifold.

9 Claims, 2 Drawing Sheets

(56) References Cited

U.S. PATENT DOCUMENTS

| | | | | |
|---|---|---|---|---|
| 4,393,752 | A | 7/1983 | Meier | |
| 4,396,362 | A | 8/1983 | Thompson et al. | |
| 4,576,557 | A | 3/1986 | Pevzner | |
| 4,639,197 | A * | 1/1987 | Tornare | F04B 3/00 417/259 |
| 4,915,602 | A * | 4/1990 | Tschopp | F04B 15/06 417/503 |
| 5,085,563 | A | 2/1992 | Collins et al. | |
| 5,127,230 | A | 7/1992 | Neeser et al. | |
| 5,265,431 | A | 11/1993 | Gaudet et al. | |
| 5,509,792 | A | 4/1996 | Sullivan et al. | |
| 5,511,955 | A | 4/1996 | Brown et al. | |
| 5,522,709 | A | 6/1996 | Rhoades | |
| 5,809,863 | A | 9/1998 | Tominaga et al. | |
| 5,860,798 | A | 1/1999 | Tschopp | |
| 6,006,525 | A | 12/1999 | Tyree, Jr. | |
| 6,056,520 | A | 5/2000 | Nguyen et al. | |
| 6,149,073 | A | 11/2000 | Hickey et al. | |
| 6,481,218 | B1 * | 11/2002 | Drelser | B60K 15/03006 62/50.6 |
| 6,663,350 | B2 | 12/2003 | Tyree, Jr. | |
| 6,722,866 | B1 | 4/2004 | Dresler | |
| 6,898,940 | B2 | 5/2005 | Gram et al. | |
| 6,901,911 | B2 | 6/2005 | Anderson et al. | |
| 7,134,851 | B2 | 11/2006 | Chenoweth | |
| 8,790,091 | B2 | 7/2014 | Mehta et al. | |
| 2010/0037967 | A1 | 2/2010 | Lu | |
| 2013/0306029 | A1 | 11/2013 | Stockner et al. | |
| 2014/0109599 | A1 | 4/2014 | Lefevre | |
| 2014/0116396 | A1 | 5/2014 | Stockner | |
| 2014/0130522 | A1 | 5/2014 | Steffen et al. | |
| 2014/0174106 | A1 | 6/2014 | Tang et al. | |
| 2014/0182559 | A1 | 7/2014 | Steffen et al. | |
| 2014/0216403 | A1 | 8/2014 | Stockner | |

FOREIGN PATENT DOCUMENTS

| | | | |
|---|---|---|---|
| DE | 3515757 | A1 | 11/1986 |
| KR | 10-1104171 | B1 | 1/2012 |
| KR | 10-2013-0089584 | A | 8/2013 |
| WO | WO 99/13229 | A1 | 3/1999 |

* cited by examiner

PUMP HAVING INLET RESERVOIR WITH VAPOR-LAYER STANDPIPE

TECHNICAL FIELD

The present disclosure relates generally to a pump and, more particularly, to a pump having an inlet reservoir with a vapor-layer standpipe.

BACKGROUND

Gaseous fuel powered engines are common in many applications. For example, the engine of a locomotive can be powered by natural gas (or another gaseous fuel) alone or by a mixture of natural gas and diesel fuel. Natural gas may be more abundant and, therefore, less expensive than diesel fuel. In addition, natural gas may burn cleaner in some applications.

Natural gas, when used in a mobile application, may be stored in a liquid state onboard the associated machine. This may require the natural gas to be stored at cold temperatures, typically about −100 to −162° C. The liquefied natural gas is then drawn from the tank by gravity and/or by a boost pump, and directed to a high-pressure pump. The high-pressure pump further increases a pressure of the fuel and directs the fuel to the machine's engine. In some applications, the liquid fuel may be gasified prior to injection into the engine and/or mixed with diesel fuel (or another fuel) before combustion.

One problem associated with pumps operating at cryogenic temperatures involves heat transfer to the fuel while inside the pump. In particular, moving components of the pump create heat through friction, and this heat (as well as ambient heat and/or heat from lubrication inside the pump) can be conducted to the fuel. If the fuel absorbs too much heat while in the pump, the fuel may gasify too early, thereby disrupting desired operation of the pump and/or the engine.

One attempt to improve pumping of a cryogenic liquid is disclosed in U.S. Pat. No. 2,837,898 (the '898 patent) that issued to Ahlstrand on Jun. 10, 1958. In particular, the '898 patent discloses a swashplate type system having three pumps disposed within a container. The container is divided into a liquid chamber and a gas chamber. Connecting rods extend through a neck of the container and the gas chamber to each of the three pumps to reciprocatingly drive the pumps. A storage tank feeds liquid fuel to a bottom of the liquid chamber. The liquid chamber is connected to the gas chamber via a connecting line, and a gas return line returns vapors and/or liquid fuel from the gas chamber to a top of the storage tank. The level of liquid fuel in the gas chamber is self-adjusting, and remains above the three pumps.

While the pump of the '898 patent may reduce some heat transfer to the liquid fuel by positioning the gas chamber above the pumps, it may still be less than optimal. In particular, the '898 patent may require a large container to accommodate both of the liquid and gas chambers, which may be difficult to package in some applications and also expensive. Further, the pumps themselves may generate heat that is still conducted into the liquid.

The disclosed pump is directed to overcoming one or more of the problems set forth above.

SUMMARY

In one aspect, the present disclosure is directed to a pump. The pump may include a manifold having an inlet, a pressure outlet, and a return outlet. The pump may also include a jacket connected to an end of the manifold to create an enclosure that is in fluid communication with the inlet of the manifold, and at least one pumping mechanism extending from the manifold into the jacket. The at least one pumping mechanism may have an inlet open to the enclosure and an outlet in communication with the pressure outlet of the manifold. The pump may further include a standpipe extending from the manifold into the enclosure. The standpipe may be in communication with the return outlet of the manifold.

In another aspect, the present disclosure is directed to another pump. This pump may include a body having an input end and an output end, and an enclosure located at the output end of the body. The enclosure may have a ceiling and a floor. The pump may further include a pumping mechanism extending from the ceiling into the enclosure, and a return outlet in communication with the enclosure. The return outlet may have an entrance located partway between the ceiling and a distal end of the pumping mechanism.

In yet another aspect, the present disclosure is directed to another pump. This pump may include a body, and an enclosure located at an end of the body. The pump may also include a pumping mechanism extending into the enclosure and partially submerged in liquid during operation. A vapor layer is maintained around a base of the pumping mechanism during operation.

DETAILED DESCRIPTION

Figure 1:
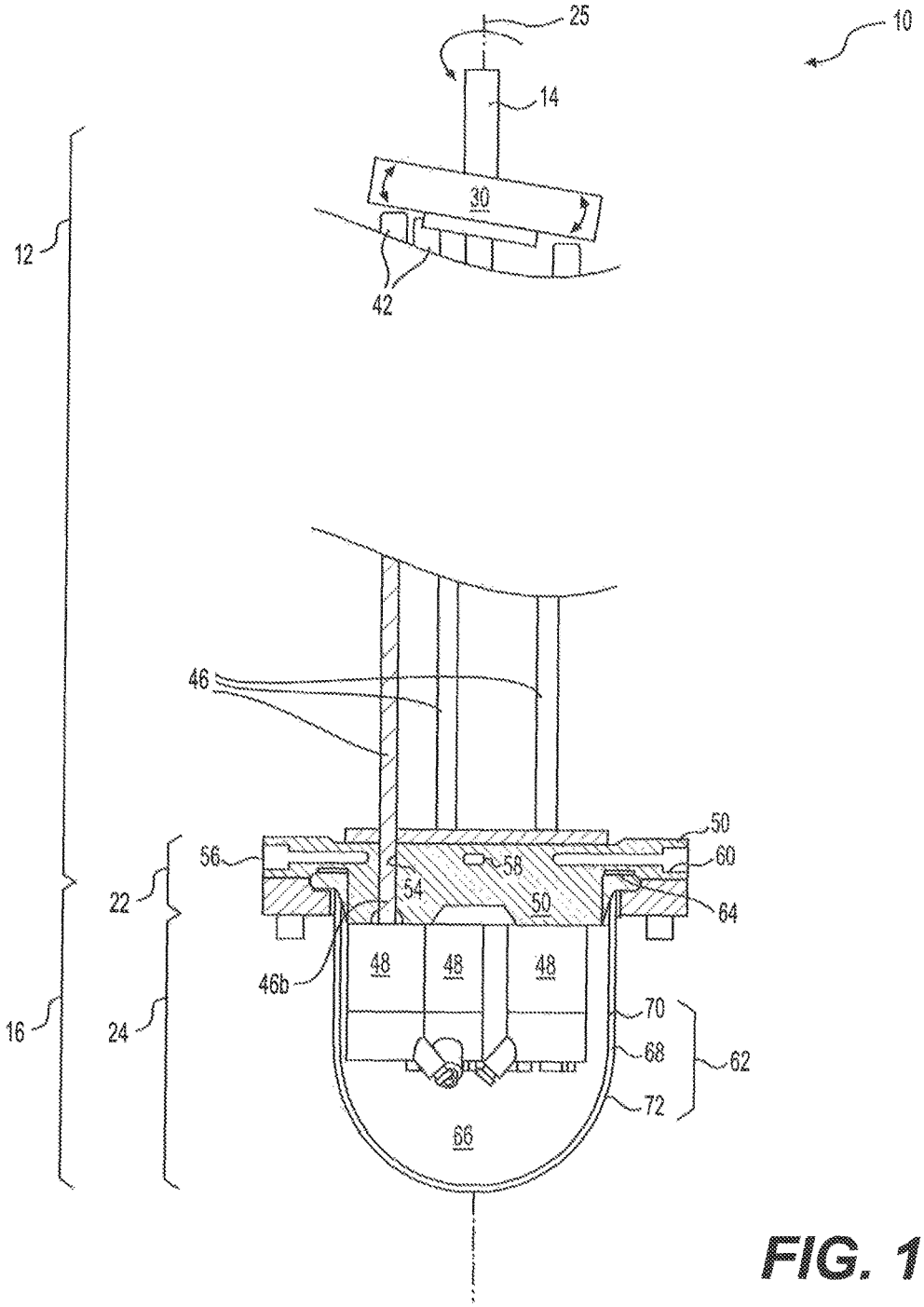
FIG. 1 is a cross-sectional illustration of an exemplary disclosed pump.

FIG. 1 illustrates an exemplary pump 10. In one embodiment, pump 10 is mechanically driven by an external source of power (e.g., a combustion engine or electric motor—not shown), to generate a high-pressure fluid discharge. In the disclosed embodiment, the fluid passing through pump 10 is liquefied natural gas (LNG) intended to be consumed by the power source providing the mechanical input. It is contemplated, however, that pump 10 may alternatively or additionally be configured to pressurize and discharge a different cryogenic fluid, if desired. For example, the cryogenic fluid could be liquefied helium, hydrogen, nitrogen, oxygen, or another fluid known in the art.

Pump 10 may be generally cylindrical and divided into two ends. For example, pump 10 may be divided into a warm or input end 12, in which a driveshaft 14 is supported, and a cold or output end 16. Cold end 16 may be further divided into a manifold section 22 and a reservoir section 24. Each of these sections may be generally aligned with driveshaft 14 along a common axis 25, and connected end-to-end. With this configuration, a mechanical input may be provided to pump 10 at warm end 12 (i.e., via shaft 14), and used to generate a high-pressure fluid discharge at the opposing cold end 16. In most applications, pump 10 will be mounted and used in the orientation shown in FIG. 1 (i.e., with reservoir section 24 being located gravitationally lowest).

Warm end 12 may be relatively warmer than cold end 16. Specifically, warm end 12 may house multiple moving components that generate heat through friction during operation. In addition, warm end 12 being connected to the power source, may result in heat being conducted from the power source into pump 10. Further, if pump 10 and the power source are located in close proximity to each other, air currents may heat warm end 12 via convection. Finally, fluids (e.g., oil) used to lubricate pump 10 may be warm and thereby transfer heat to warm end 12. In contrast, cold end 16 may continuously receive a supply of fluid having an extremely low temperature. For example, LNG may be supplied to pump 10 from an associated storage tank at a temperature less than about −120° C. This continuous supply of cold fluid to cold end 16 may cause cold end 16 to be significantly cooler than warm end 12. If too much heat is transferred to the fluid within pump 10 from warm end 12, the fluid may gasify within cold end 16 prior to discharge from pump 10, thereby drastically reducing an efficiency of pump 10. This may be undesirable in some applications.

Pump 10 may be an axial plunger type of pump. In particular, shaft 14 may be rotatably supported within a housing (not shown), and connected at an internal end to a load plate 30. Load plate 30 may oriented at an oblique angle relative to axis 25, such that an input rotation of shaft 14 may be converted into a corresponding undulating motion of load plate 30. A plurality of tappets 42 may slide along a lower face of load plate 30, and a push rod 46 may be associated with each tappet 42. In this way, the undulating motion of load plate 30 may be transferred through tappets 42 to push rods 46 and used to pressurized the fluid passing through pump 10. A resilient member (not shown), for example a coil spring, may be associated with each push rod 46 and configured to bias the associated tappet 42 into engagement with load plate 30. Each push rod 46 may be a single-piece component or, alternatively, comprised of multiple pieces, as desired. Many different shaft/load plate configurations may be possible, and the oblique angle of shaft 14 may be fixed or variable, as desired.

Manifold section 22 may include a manifold 50 that performs several different functions. In particular, manifold 50 may function as a guide for push rods 46, as a mounting pad for a plurality of pumping mechanism 48, and as a distributer/collector of fluids for pumping mechanisms 48. Manifold 50 may connect to warm end 12, and include a plurality of bores 54 configured to receive push rods 46. In addition, manifold 50 may have formed therein a common inlet 56, a high-pressure outlet 58, and a return outlet 60. It should be noted that inlet 56 and outlets 58, 60 are not shown in any particular orientation in FIG. 1, and that inlet 56 and outlets 58, 60 may be disposed at any desired orientation around the perimeter of manifold 50. It is further contemplated that inlet 56 may be disposed at an alternative location (e.g., within reservoir section 24), if desired.

Reservoir section 24 may include a close-ended jacket 62 connected to manifold section 22 (e.g., to a side of manifold 50 opposite warm end 12) by way of a seal and/or an insulating plate 64 to form an internal enclosure 66. Enclosure 66 may be in open fluid communication with common inlet 56 of manifold 50. In the disclosed embodiment, jacket 62 may be insulated, if desired, to inhibit heat from transferring inward to the fluid contained therein. For example, a gap 68 may be provided between internal and external layers 70, 72 of jacket 62, In some embodiments, a vacuum may be formed in gap 68.

Figure 2:
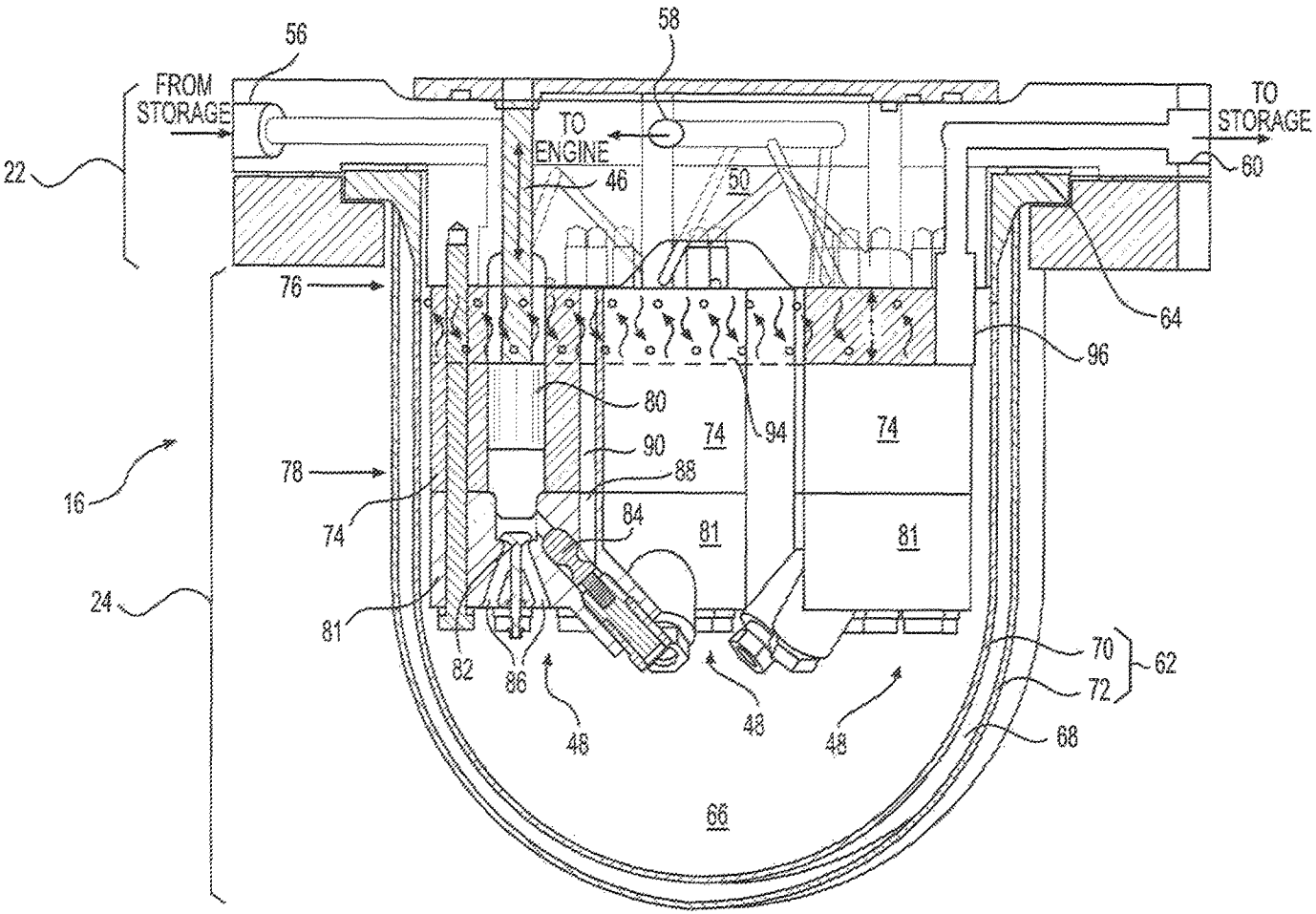
FIG. 2 is an enlarged cross-sectional illustration of an exemplary portion of the pump shown in FIG. 1.

Any number of pumping mechanisms 48 may be connected to manifold 50 and extend into enclosure 66. As shown in FIG. 2, each pumping mechanism 48 may include a generally hollow barrel 74 having a base end 76 connected to manifold 50, and an opposing distal end 78. A head 81 may be attached to distal end 78 to close off barrel 74. A lower end of each push rod 46 may extend through manifold 50 into a corresponding barrel 74 and engage (or be connected to) a plunger 80. In this way, the reciprocating movement of push rod 46 may translate into a sliding movement of plunger 80 between a Bottom-Dead-Center position (BDC) and a Top-Dead-Center (TDC) position within barrel 74.

Head 81 may house valve elements that facilitate fluid pumping during the movement of plungers 80 between BDC and TDC positions, Specifically, head 81 may include a first check valve 82 associated with inlet flow, and a second check valve 84 associated with outlet flow. During plunger movement from TDC to BDC (upward movement in FIG. 2), pressurized fluid from an external boost pump (not shown) may unseat an element of valve 82, allowing the fluid to be directed into barrel 74. This fluid may flow from enclosure 66 through one or more passages 86 into barrel 74. During an ensuing plunger movement from BDC to TDC (downward movement in FIG. 2), high pressure may be generated within barrel 74 by the volume contracting inside barrel 74. This high pressure may function to reseat the element of valve 82 and unseat an element of valve 84, allowing fluid from within enclosure 66 to be pushed out through one or more passages 88 of head 81. Then during the next plunger movement from TDC to BDC, the element of valve 84 may be resented. One or both of the elements of valves 82 and 84 may be spring-biased to a particular position, if desired (e.g., toward their seated and closed positions). The flow being discharged from barrel 74 through passage 88 may be directed through an axially oriented passage 90 formed within a wall of barrel 74. All high-pressure flows from passages 90 of all pumping mechanisms 48 may then join each other inside manifold 50 for discharge from pump 10 via high-pressure outlet 58.

Enclosure 66 may be open to inlet 56, and nearly completely filled with liquid during a pumping operation. Accordingly, each of pumping mechanisms 48 may be at least partially submerged within the liquid during operation. For example, at least an end portion of head 81 (e.g., at least the entrances of passages 86) may be located a distance below a liquid surface inside enclosure 66. In most instances, however, enclosure 66 may not be completely filled with liquid, so as to allow a layer 94 of vapor to thrill at a ceiling of enclosure 66. It should be noted that pump 10 may normally be packaged for use in the orientation shown in FIGS. 1 and 2, such that manifold 50 forms a ceiling of enclosure 66, and jacket 62 constitutes a floor and walls thereof. In this way, vapor layer 94 may be formed at manifold 50 and around base ends 76 of pumping mechanisms 48.

Vapor layer 94 may have a thickness t controlled by a configuration of return outlet 60. In particular, return outlet 60 may have an exit open to an upper portion of the external storage tank discussed above, and an entrance positioned inside (i.e., open to) enclosure 66 at an axial location between the ceiling and the floor of enclosure 66 (e.g., at a desired distance away from the ceiling). Return outlet 60 may be configured to allow liquid and/or vapor within enclosure 66 to flow back to the storage tank, thereby maintaining a desired liquid level within enclosure 66. With the entrance of return outlet 60 at an axial position away from the ceiling of enclosure 66, vapor that is located between the entrance and the ceiling may become trapped, thereby creating layer 94 having the thickness t about equal to the distance between the entrance and the ceiling. In the disclosed embodiment, the surface of the fluid, inside enclosure 66 (i.e., a line separating the vapor from the liquid, and also the location of the entrance of return outlet 60) may coincide with an upper (i.e., low-pressure) end-face location of plunger 80 when plunger 80 is at its BDC position. In other words, vapor layer 94 may axially overlap base end 76 of barrel 74, but extend downward only to a location at which the end-face of plunger 80 comes to rest at its BDC position during operation. That is, vapor layer 94 may terminate short of an axial operational range of plunger 80.

In the disclosed embodiment, return outlet 60 includes a standpipe 96 that extends downward from the ceiling of enclosure 66 (i.e., downward from manifold 50) to the desired entrance location inside jacket 62. In this configuration, the thickness t of vapor layer 94 may be adjusted by adjusting a length of standpipe 96. It is contemplated, however, that return outlet 60 could have a different entrance configuration, if desired. For example, the entrance of return outlet 60 could be provided within jacket 62, within one or more barrels 74, and/or within another component of reservoir section 24. In this configuration, standpipe 96 may be omitted.

INDUSTRIAL APPLICABILITY

The disclosed pump finds potential application in any fluid system where heat transfer through the pump is undesirable. The disclosed pump finds particular applicability in cryogenic applications, for example power system applications having engines that burn LNG fuel, One skilled in the art will recognize, however, that the disclosed pump could be utilized in relation to other fluid systems that may or may not be associated with a power system. The disclosed pump may inhibit heat transfer from the warm end of the pump to fluid at the cold end of the pump by providing a vapor layer of a strategic thickness at a unique location. This vapor layer may form a barrier to heat transfer that helps to reduce the fluid in the cold end from vaporizing. Operation of pump 10 will now be explained.

Referring to FIG. 1, when driveshaft 14 is rotated by an engine (or another power source), load plate 30 may be caused to undulate in an axial direction. This undulation may result in translational movement of tappets 42 and corresponding movements of push rods 46 and engaged plungers 80. Accordingly, the rotation of driveshaft 14 may cause axial movement of plungers 80 between TDC and BDC positions. During this time, LNG fuel (or another fluid) may be supplied from an external storage tank (not shown) to enclosure 66 via common inlet 56. In some embodiments, the fluid may be transferred from the storage tank to pump 10 via a separate boost pump (not shown), if desired.

As plungers 80 cyclically rise and fall within barrels 74, this reciprocating motion may function to allow liquid to flow from enclosure 66 through head 81 (i.e., through passages 86 and past check valve 82) into barrels 74 and to push the fluid from barrels 74 via head 81 (i.e., via passage 88 and past check valve 84) at an elevated pressure. The high-pressure liquid may flow through passages 90 in barrels 74 and through high-pressure outlet 58 back to the engine.

During operation of pump 10, excess liquid and/or vapor inside enclosure 66 may also be returned to the external storage tank in order to maintain a desired pressure within enclosure 66. In particular, when the level of liquid inside enclosure 66 is lower than the entrance of return outlet 60, only vapor may pass through return outlet 60 to the storage tank. And when the level of liquid inside enclosure 66 is higher than the entrance of return outlet 60, only liquid may pass through return outlet 60. In the disclosed embodiment, the return of fluid may be substantially unrestricted. In other applications, however, a relief valve (not shown) may be associated with return outlet 60, if desired. In this way, regardless of the usage rate of the fluid from enclosure 66 and/or the supply rate of fluid to enclosure 66, enclosure 66 may not be overfilled with fluid and the resulting pressure may be maintained at a desired level.

Vapor layer 94 may be formed within enclosure 66 to have the desired thickness t, and the desired thickness t may correspond with an amount of insulation located between warm end 12 and cold end 16. In particular, a thicker vapor layer 94 may result in less heat transfer, whereas a thinner vapor layer 94 may result in more heat transfer. Vapor layer 94, in the disclosed embodiment may have the thickness t that results in desired insulation of manifold 50 and base ends 76 of pumping mechanisms 48 from a remainder of reservoir section 24. By keeping the liquid in enclosure 66 away from manifold 50 and away from base ends 76, the amount of heat transferred from these components to the liquid may be insignificant.

Because the disclosed pump 10 may utilize a single chamber (i.e., enclosure 66), the space consumed by pump 10 may be kept small. This may improve packaging of pump 10, while also lowering a cost thereof. Further, by locating vapor layer 94 at the base end 76 of barrels 74, some of the heat generated within barrels 74 may be isolated from the liquid inside enclosure 66.

It will be apparent to those skilled in the art that various modifications and variations can be made to the pump of the present disclosure. Other embodiments of the pump will be apparent to those skilled in the art from consideration of the specification and practice of the pump disclosed herein. It is intended that the specification and examples be considered as exemplary only, with a true scope being indicated by the following claims and their equivalents.

What is claimed is:

1. A pump, comprising:

a manifold having an inlet, a pressure outlet, and a return outlet;

a jacket connected to an end of the manifold to create an enclosure that is in fluid communication with the inlet of the manifold;

at least one pumping mechanism extending from the manifold into the jacket and having an inlet open to the enclosure and an outlet in communication with the pressure outlet of the manifold, wherein the at least one pumping mechanism includes:

a push rod configured to be driven by a load plate, a lower end of the push rod extending through an opening in the manifold;

a barrel having a base end connected to the manifold, and a distal end;

a plunger connected to the lower end of the push rod and slidingly disposed within the barrel; and a head connected to the distal end of the barrel; and a standpipe extending from the manifold into the enclosure and being in communication with the return outlet of the manifold, wherein the standpipe extends to an axial location between the base end and the distal end of the barrel;

the plunger has a high-pressure end face and an opposing low-pressure end face;

the plunger reciprocates within the barrel between a bottom-dead-center position and a top-dead-center position; and the standpipe extends to an axial location corresponding with the opposing low-pressure end face of the plunger when the plunger is located at about the bottom-dead-center position.

2. The pump of claim 1, wherein the at least one pumping mechanism includes multiple pumping mechanisms.

3. The pump of claim 1, wherein the head includes an inlet and an outlet, both in communication with the distal end of the barrel.

4. The pump of claim 3, further including:

a first check valve located in the outlet of the head; and a second check valve located in the inlet of the head.

5. The pump of claim 3, wherein the barrel includes a high-pressure passage extending axially from the distal end to the base end.

6. The pump of claim 1, wherein the standpipe terminates short of an axial operational range of the plunger.

7. The pump of claim 1, wherein the standpipe is configured to:

direct only vapor out of the enclosure when a vapor layer around the base end of the barrel has a thickness greater than a desired thickness; and direct only liquid out of the enclosure when the thickness of the vapor layer is less than the desired thickness.

8. A pump, comprising:

a body;

a manifold having an inlet, a pressure outlet, and a return outlet;

an enclosure located at an end of the body;

a pumping mechanism extending into the enclosure and partially submerged in liquid during operation, wherein a vapor layer is maintained around a base of the pumping mechanism during operation, the pumping mechanism including:

a push rod configured to be driven by a load plate rotatably mounted in the body, a lower end of the push rod extending through an opening in the manifold and guided by the manifold;

a barrel having a base end connected to the manifold, and a distal end;

a plunger connected to the lower end of the push rod and slidingly disposed within the barrel; and a head connected to the distal end of the barrel; and a standpipe extending from the manifold into the enclosure and being in communication with the return outlet of the manifold, wherein the standpipe extends to an axial location between the base end and the distal end of the barrel;

the plunger has a high-pressure end face and an opposing low-pressure end face;

the plunger reciprocates within the barrel between a bottom-dead-center position and a top-dead-center position; and the standpipe extends to an axial location corresponding with the opposing low-pressure end face of the plunger when the plunger is located at about the bottom-dead-center position.

9. The pump of claim 8, wherein:

the pumping mechanism is a first pumping mechanism; and the pump further includes:

a second pumping mechanism extending into the enclosure and partially submerged in liquid during operation.

* * * * *